US005507473A

United States Patent [19]

Hammer et al.

[11] Patent Number: 5,507,473

[45] Date of Patent: Apr. 16, 1996

[54] GUARD RAIL POST

[75] Inventors: Floyd V. Hammer, Union; Brian Harper, Cedar Falls, both of Iowa

[73] Assignee: Hammer's Inc., Iowa Falls, Iowa

[21] Appl. No.: 219,201

[22] Filed: Mar. 29, 1994

[51] Int. Cl.[6] ..... E01F 15/00

[52] U.S. Cl. ..... 256/13.1; 256/19; 256/59; 256/60; 404/6; 52/309.1

[58] Field of Search ..... 256/13.1, 19, 59, 256/60; 404/6; 52/309.1, 309.15, 309.16

[56] References Cited

U.S. PATENT DOCUMENTS

| | | | |
|---|---|---|---|
| 2,410,228 | 10/1946 | Maxey | 256/13.1 |
| 3,317,189 | 5/1967 | Rubenstein | 52/DIG. 7 X |
| 3,776,520 | 12/1973 | Charles et al. | 256/13.1 |
| 3,784,167 | 1/1974 | Glaesener | 256/13.1 |
| 3,963,218 | 6/1976 | Glaesner | 256/13.1 |
| 4,655,434 | 4/1987 | Bronstad | 256/13.1 |
| 4,824,627 | 4/1989 | Hammer et al. | 264/328.14 X |
| 4,979,817 | 12/1990 | Crips, Sr. | 256/13.1 |
| 5,169,127 | 12/1992 | Eynard | 256/13.1 |
| 5,219,241 | 6/1993 | Picton | 404/6 |
| 5,367,844 | 11/1994 | Diedrich | 52/309.1 X |
| 5,404,685 | 4/1995 | Collins | 256/19 X |

*Primary Examiner*—Brian K. Green
*Assistant Examiner*—Andrea Chop
*Attorney, Agent, or Firm*—Zarley, McKee, Thomte, Voorhees, & Sease

[57] ABSTRACT

A guard rail post is molded from a plastic recycled material which is reinforced with a vertical and a horizontal reinforcing member embedded within an L-shaped plastic body.

6 Claims, 2 Drawing Sheets

GUARD RAIL POST

BACKGROUND OF THE INVENTION

The present invention relates to a guard rail post.

Traffic guard rails are currently used along highways and streets for deflecting the paths of vehicles which are out of control. These guard rails are supported by posts embedded in the ground. Some of the posts are L-shaped and some of them are not. Also some of them are constructed entirely of wood or entirely of steel.

In the case of wood posts, the horizontal leg of the L-shape is a separate block attached to the vertical body of the post. Typically guard rail posts are spaced at 6.25 feet intervals although this spacing may vary in some situations.

It is important that the guard rails be able to withstand impacts of substantial force without breaking. It is also important that these rail posts be protected against ultraviolet degradation and that they be capable of being driven into the ground with a pile driver.

Therefor a primary object of the present invention is the provision of an improved guard rail post.

A further object of the present invention is the provision of an improved guard rail post which is manufactured from recycled plastic having elongated reinforcing members embedded therein to provide additional strength.

A further object of the present invention is the provision of an improved guard rail post which will withstand a minimum impact fracture energy of 5.5 foot-kips based on a 60–72 inch long post embedded to a depth of 32 to 42 inches in the ground and subjected to an impact point 21 inches above the ground.

A further object of the present invention is the provision of an improved guard rail post which as part of a complete guard rail system will exhibit a deflection of no more than 36 inches when impacted by a 4500 pound car traveling at 60 miles per hour at an impact angle of 25°.

A further object of the present invention is the provision of an improved guard rail post which utilizes recycled plastic.

A further object of the present invention is the provision of an improved guard rail post which includes an offset block or L-shaped horizontal portion which is not less than six inches nor more than eight inches long.

A further object of the present invention is the provision of an improved guard rail post which will provide the above resistance to impact and bending with a post having a maximum width of 16 inches.

A further object of the present invention is the provision of an improved guard rail post which is capable of being driven into the ground by a pile driver.

SUMMARY OF THE INVENTION

The foregoing objects are achieved with a guard rail post which is manufactured from recycled plastic suitably reinforced to achieve the required strength properties discussed above, and molded with an offset block as an integral feature. A horizontal reinforcing member which is hollow is imbedded within the offset block for receiving a bolt to attach the rail to the horizontal leg of the guard post.

DETAILED DESCRIPTION OF THE PREFERRED EMBODIMENT

Figure 1:
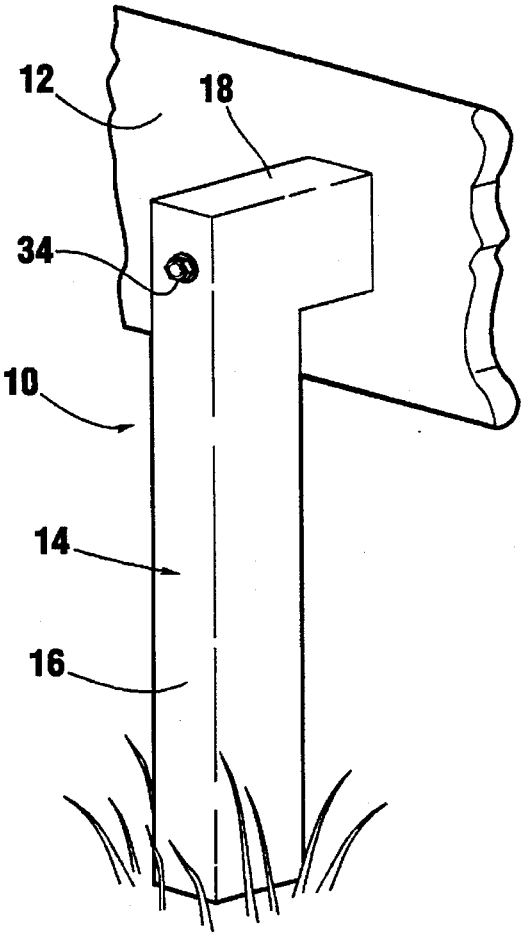
FIG. 1 is a perspective view of the guard rail post of the present invention.
Figure 2:
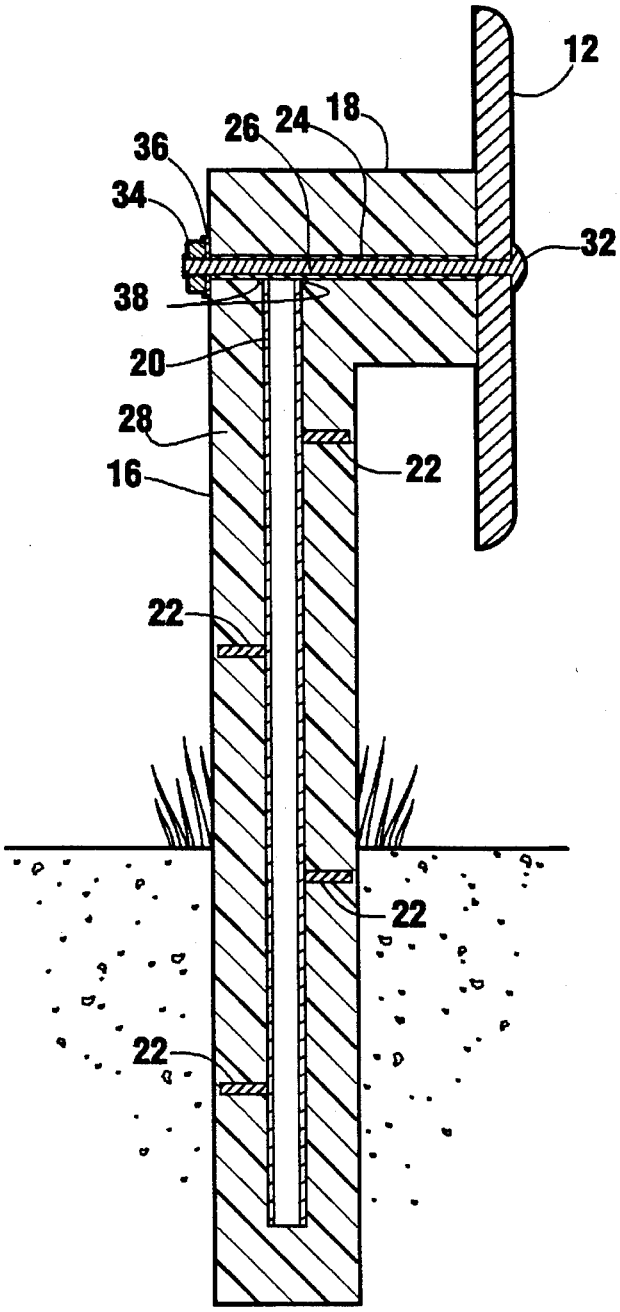
FIG. 2 is a vertical sectional view thereof.
Figure 5:
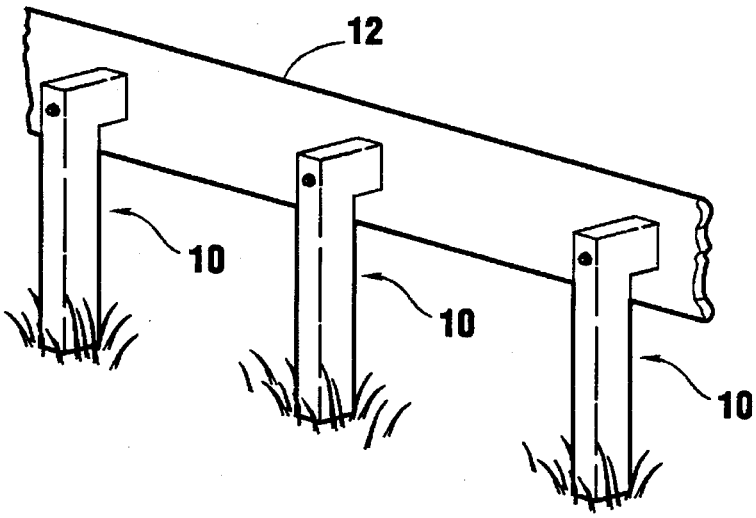
FIG. 5 is a perspective view of a guard rail mounted on several spaced apart guard rail posts.

Referring to the drawings a guard rail post 10 is shown in FIGS. 1 and 5 supporting a horizontal guard rail 12 used along highways or streets to protect out of control vehicles from such dangers as bridge support columns or other roadside hazards. The guard rail post 10 is comprised of a one piece molded L-shaped body member 14 manufactured from plastic material and shaped into a vertical leg 16 and a horizontal leg 18. Horizontal leg 18 may also referred to as an "offset block". Embedded within the plastic body member 14 is a vertical pipe 20 having a plurality of lugs 22 extending radially outwardly therefrom. The lugs 22 do not extend completely to the periphery of the plastic so that they are fully embedded within the plastic and hidden from view. The lugs 22 and the vertical pipe 20 provide substantial strengthening to the body member. The upper end of the vertical pipe 20 is welded to a horizontal pipe 24 which has a pipe bore 26 extending therethrough. Pipe 24 is exposed at the forward and rear ends of the horizontal leg 18 so that a bolt 32 may be fitted therethrough to secure the guard rail 12 to the end of the L-shaped horizontal leg 18. A nut 34 and washer 36 are threadably secured to the opposite end of bolt 32 to secure the rail 12 to the guard post 10. Preferably the horizontal pipe 24 and the vertical pipe 20 are welded together along a welded joint 38. Completely surrounding the horizontal pipe 24 and the vertical pipe 20 as well as the lugs 22 is a plastic material 28. Preferably the plastic material is recycled plastic. Various mixtures of recycled plastic may be used, but the preferred mixture is a blend of high density polyethylene (HDPE) and low density polyethylene (LDPE) compounded to give the correct balance of strength and temperature stability. Temperature stability is needed to avoid the possibility of failure during low ambient temperatures commonly encountered in winters. A preferred blend is in the range of 35% to 65% high density polyethylene and 35% to 60% low density polyethylene. In addition the plastic may be provided with a 2% to a 2.5% carbon black to provide stability against ultraviolet degradation.

Figure 4:
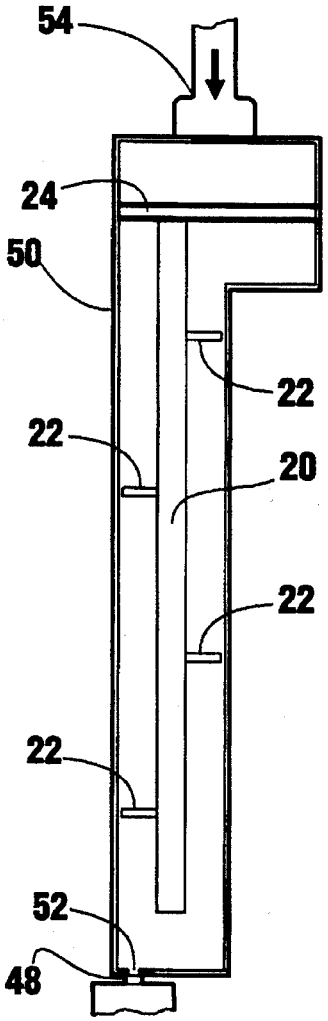
FIG. 4 is a sectional view taken along 4—4 of FIG. 3.

The vertical steel pipe 20 can vary in diameter, and can be either solid or hollow. Preferably this vertical pipe 20 is formed from a pipe 2½ inches in diameter, but the size can vary from 2⅜ inches to 2⅞ inches. The lugs 22 provide the function of locating the pipe 20 in the correct position inside a mold 50 (FIG. 4) and also provide the function of being a positive anchor for the bolt in the plastic material 28. The axial ends of the lugs 22 are spaced a small distance inwardly from the walls of the mold 50 to allow some float of the pipe 20 to take place during the molding process and to cause the ends of the lugs 22 to be completely embedded in the plastic after the molding is complete.

Figure 3:
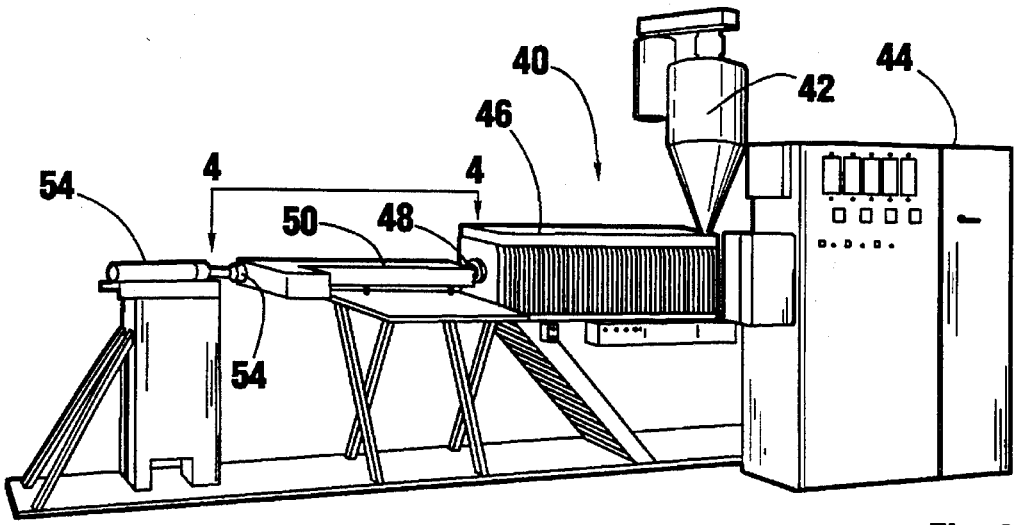
FIG. 3 is a perspective view of a molding machine showing a mold for molding the guide rail post of the present invention.

The guard rail post 10 is molded utilizing the plastic molding machine 40 shown in FIG. 3. Machine 40 includes a hopper 42 for storing ground recycled plastic materials and for introducing those materials to the end of a screw extruder 46. A control panel 44 controls the screw extruder 46. Screw extruder 46 has an outlet die 48 from which the molded plastic material is extruded. The material coming out of die 48 is molten and plastic in consistency due to the heat and pressure generated by the screw extruder. A mold 50 is fitted over the screw extruder outlet 48 and is held in place over that outlet 48 by means of a hydraulic ram 54. The mold 50 includes an inlet opening 52 which is registered with the die opening 48 of the screw extruder. Fitted within the mold 50 are the vertical pipe 20, the lugs 22, and the horizontal pipe 24, all of which are attached together and held in the position shown in FIG. 4. In this position the opposite ends of horizontal pipe 24 bear against the walls of the mold so that the plastic material cannot enter the ends of the longitudinal bore 26 of horizontal pipe 24. The plastic is extruded from the outlet opening 48 of the extruder at very low mold pressures in the range of from 100 to 600 PSI. The mixture exiting through die 48 is heated to a temperature of approximately 350° to 600° F. by the pressure of the screw as well as by heating elements surrounding the screw extruder 46.

In order to qualify for use on interstate highways guard rail posts having a vertical leg of from 60 to 72 inches and a horizontal leg which extends from the face of the vertical leg from between six to eight inches, must pass the following requirements:

1. The guard rail posts must withstand without fracturing a dynamic impact fracture energy of 5.5 foot kips from an impact point 21 inches above the ground.
2. Exhibit a deflection of no more than 36 inches when impacted by a 4500 pound car traveling at 60 mph at an impact angle (as measured with respect to the rail 12) of 25°.
3. Withstand ultraviolet degradation.
4. Be manufactured with a vertical post and offset block having a width no greater than 16 inches.
5. Be capable of being driven into the ground by a pile driver.

When subjected to test 1 above, the guard rail post of the present invention withstood 19 foot-kips. While test 2 has not yet been performed on the guard rail post of the present invention, the results of test 1 indicate that the post will also pass test 2. The post of the present invention will also pass test 3 when made with carbon black and will pass tests 4 and 5.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A guard rail post adapted to support a guard rail along a highway comprising:

an L-shaped body having a vertical leg with upper and lower ends and a horizontal leg with a first end connected to said upper end of said vertical leg and a second end;

said body being formed of plastic and having a first elongated reinforcing member and a second elongated reinforcing member embedded in said plastic, said plastic comprising recycled plastic including 35% to 65% high density polyethylene and 35% to 60% low density polyethylene molded around said first and second reinforcing members at a mold pressure of from approximately 100 to 600 p.s.i. and at a mold temperature of approximately 350° F. to 600° F.;

said first reinforcing member comprising a steel pipe which is from 2⅜ to 2⅞ inches in diameter, said steel pipe extending vertically within said vertical leg and having a plurality of lugs spaced along its length and extending horizontally outwardly therefrom;

said second reinforcing member extending horizontally within said horizontal leg;

said first and second reinforcing members being rigidly attached to one another;

said second reinforcing member having opposite ends, one of said opposite ends being hollow and being exposed to the exterior of said horizontal leg adjacent said second end thereof for receiving securing means to secure said guard rail to said second end of said body;

said body remaining free from fracture when said vertical leg is 60 to 72 inches long and has said lower end embedded in the ground to a depth of 32 to 42 inches, and when subjected to an impact fracture energy of up to 5.5 foot-kips at an impact point 21 inches above the ground.

2. A guard rail post according to claim 1 wherein said body will deflect no more than approximately 36 inches when said vertical leg is 60 to 72 inches long and has said lower end embedded in the ground to a depth of 32 to 42 inches and when subjected to impact by a 4500 pound vehicle traveling at 60 mph at an impact angle of 25°.

3. A guard rail post according to claim 1 wherein said second reinforcing member has a bore extending therethrough for receiving a bolt to attach said guard rail to said second end of said horizontal leg.

4. A guard rail post according to claim 1 wherein said plastic further comprises carbon black for stabilization against ultraviolet degradation.

5. In combination:

a plurality of spaced apart guard rail posts, each of said guard rail posts being formed from an L-shaped body having a vertical leg with a lower end embedded in the ground and an upper end and having a horizontal leg with a first end connected to said upper end of said vertical leg and a second end;

said body being formed of plastic and having a first elongated reinforcing member and a second elongated reinforcing member embedded in said plastic;

said plastic comprising recycled plastic including 35% to 65% high density polyethylene and 35% to 60% low density polyethylene molded around said first and second reinforcing members;

said first reinforcing member extending vertically within said vertical leg;

said second reinforcing member extending horizontally within said horizontal leg;

said first and second reinforcing members being rigidly attached to one another;

said second reinforcing member having opposite ends, one of said opposite ends being hollow and being exposed to the exterior of said horizontal leg adjacent said second end;

an elongated guard rail horizontally disposed transversely to the longitudinal axes of said horizontal legs of said guard rail posts;

securing means securing said guard rail to said second ends of said horizontal legs of said guard rail posts, said securing means extending into said one hollow end of each of said second reinforcing members.

6. A combination according to claim 5 wherein said vertical legs of said guard rail posts are from 60 to 72 inches long and are embedded in the ground to a depth of from 32 to 42 inches and will remain free from fracture when subjected to an impact energy of 5.5 foot-kips at an impact point 21 inches above the ground.

* * * * *